US010311691B2

(12) United States Patent
Yang

(10) Patent No.: US 10,311,691 B2
(45) Date of Patent: Jun. 4, 2019

(54) ANTI-THEFT TAG WITH ATTACHING PANEL

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days.

(21) Appl. No.: 15/984,998

(22) Filed: May 21, 2018

(65) Prior Publication Data

US 2018/0276964 A1 Sep. 27, 2018

Related U.S. Application Data

(63) Continuation of application No. 15/408,368, filed on Jan. 17, 2017, now Pat. No. 9,997,037.

(60) Provisional application No. 62/279,287, filed on Jan. 15, 2016.

(51) Int. Cl.

| | |
|---|---|
| ***G08B 13/14*** | (2006.01) |
| ***G08B 13/24*** | (2006.01) |
| *G08B 25/00* | (2006.01) |

(52) U.S. Cl.

CPC ..... *G08B 13/2434* (2013.01); *G08B 13/2417* (2013.01); *G08B 13/2448* (2013.01); *G08B 25/008* (2013.01)

(58) Field of Classification Search

CPC ..... G08B 13/2434; G08B 3/10; G08B 13/06; G08B 13/2448; H04B 1/3883

USPC ..... 340/572.8, 568.1, 568.2, 568.4, 568.8, 340/571

See application file for complete search history.

(56) References Cited

U.S. PATENT DOCUMENTS

| | | | | |
|---|---|---|---|---|
| 8,269,631 | B2 | 9/2012 | Yang | |
| 8,373,565 | B2 | 2/2013 | Yang | |
| 8,421,633 | B2 | 4/2013 | Yang | |
| 8,452,868 | B2 | 5/2013 | Shafer et al. | |
| D697,825 | S | 1/2014 | Yang | |
| 8,890,694 | B2 | 11/2014 | Yang | |
| 8,917,180 | B2 * | 12/2014 | Sayegh | E05B 73/0029 340/572.9 |
| D727,191 | S | 4/2015 | Yang | |
| D742,773 | S | 11/2015 | Yang | |
| 9,245,432 | B2 | 1/2016 | Yang | |
| 9,311,797 | B2 | 4/2016 | Yang | |
| 9,443,404 | B2 | 9/2016 | Grant et al. | |
| 9,521,227 | B2 | 12/2016 | Yang | |
| 2017/0206762 | A1 | 7/2017 | Yang | |

* cited by examiner

*Primary Examiner* — Toan N Pham
(74) *Attorney, Agent, or Firm* — Brian W. Foxworthy; Robert R. Waters; Waters Law Group, PLLC

(57) ABSTRACT

An electronic article surveillance (EAS) device has a housing containing EAS electronics and a panel extending from the housing. An adhesive element on the panel provides a means of attaching the EAS device to an object to be monitored. The EAS device has a switch to detect when the EAS device is mounted to an object. The electronics within the housing monitor the switch. The switch may be associated with, or mounted in, the panel. The panel may be hinged to the housing. The panel may fold flat to the housing when not in use, and the switch will disconnect any power source to conserve energy when the panel is closed. The EAS electronics can communicate with external devices and an external EAS system which may include cloud functionality.

15 Claims, 9 Drawing Sheets

ANTI-THEFT TAG WITH ATTACHING PANEL

CROSS REFERENCE TO RELATED APPLICATIONS

This application is a continuation-in-part application of U.S. patent application Ser. No. 15/408,368, filed on Jan. 17, 2017. U.S. patent application Ser. No. 15/408,368 in turn claims priority to U.S. Provisional Application 62/279,287, filed on Jan. 15, 2016. The entire disclosures contained in the specification and figures for U.S. patent application Ser. No. 15/408,368 and U.S. Provisional Application 62/279,287, including the attachments thereto, are incorporated herein by reference.

FIELD OF THE INVENTION

This invention relates to the prevention of the theft of goods in retail locations. More specifically, this invention relates to the prevention of the theft by an easily attachable electronic article surveillance (EAS) device.

BACKGROUND OF THE INVENTION

Theft of goods in the retail environment is a serious concern. Theft cuts into the margins of a business making it more difficult for a business to compete and succeed. Electronic article surveillance (EAS) devices are frequently employed to prevent the theft of goods above a certain value. Some consumer goods are high value, but present difficulty as to how to attach an EAS device. For example, shoes are an expensive consumer item, but depending on the style, it may be difficult to attach an EAS device. This is particularly true, if it is desired to make the shoe available for fitting. In this case, despite the theft risk, effective sales and marketing still requires that consumer goods be available for a consumer to hold and review, and in some cases, try on. Therefore there is a need for an easy and effective way to protect consumer articles on display while giving a shopper the full ability to hold and inspect the product. Additionally, since large quantities of EAS devices are used, it is preferable that the devices be compact when not in use.

SUMMARY FOR EMBODIMENTS OF THE INVENTION

Some consumer items do not have external features that facilitate the easy attachment of EAS devices. One way to attach an EAS device to such an object is by using an adhesive element. This adhesive element may be on a panel, and the panel may be hinged to a housing of the EAS device.

The adhesive element may also work in conjunction with another feature. For example, portable electronics are among consumer goods to which it may not be easy to attach an EAS device. Portable electronics have onboard rechargeable batteries and ports for the connection of chargers. Some embodiments of an EAS device for electronic devices may combine the adhesive element with a plug that inserts into a charging port.

In embodiments of EAS devices for portable electronic device, the anti-theft devices have a plug compatible with the charging port of an electronic device extending from the housing at a first location. A plug like the charging port of the electronic device is positioned at a second location on the housing. In some embodiments of the EAS device, there is electrical continuity between the plug on the housing compatible with the charging port and the plug like the charging port. This allows a charger to be plugged into the anti-theft tag to charge the electronic device, while the tag is plugged into the electronic device. The adhesive element, along with the plug, keeps the EAS device attached to the portable electronic device.

Other consumer items may not have a convenient feature such as a charging port to assist the adhesive element in maintaining an EAS device on the item to be protected. Shoes are such items. Shoes occur in a large variation of styles and it is desirable that, whatever the style of shoe, a consumer can handle and try on the shoe. The common feature among shoes is the sole of the shoe. The adhesive element of an EAS device can attach to the sole without substantially altering the appearance of a shoe or prevent a consumer of trying the shoe for fit. For items such as shoes, the adhesive element alone is capable of keeping the EAS device attached.

The housing of the EAS device encloses electronic article surveillance electronics. The EAS electronics may include a passive EAS element, and, or, active EAS elements. Two types of possible passive EAS elements are acousto-magnetic (AM) passive elements which function at approximately 58 kHz frequency and ferrite core and coil passive elements. Both AM passive elements and core and coil passive elements generate signals in response to interrogation fields.

Active EAS electronics may comprise: a microprocessor; a motion sensor; a magnetometer; switches; wireless communication elements such as a radio frequency (RF) transmitter and receiver, or RF transceiver or an infrared communication port; an audible sound generator; and a battery, or other power source, powering the foregoing elements. The electronics can monitor the status of switches, the connections to the phone and charger, and the status of the battery. The microprocessor can execute machine readable instructions to interpret the state of switches, plugs, and sensors, to communicate with other devices, and to generate alarms if an alarm condition is determined.

Depending on the application and the resulting embodiment of the EAS device, a switch may be positioned in different locations. Some embodiments may position the switch in the housing. For example, for portable electronic devices, a switch may be located in the housing of the EAS device to contact the portable electronic device when the EAS device is attached. Other embodiments may position the switch in the panel. With the switch located in the panel, the switch is proximal to the adhesive elements and there is less variability in the interaction between the switch and the object to which the EAS device is attached. The switch itself may take different forms as well.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figure 2:
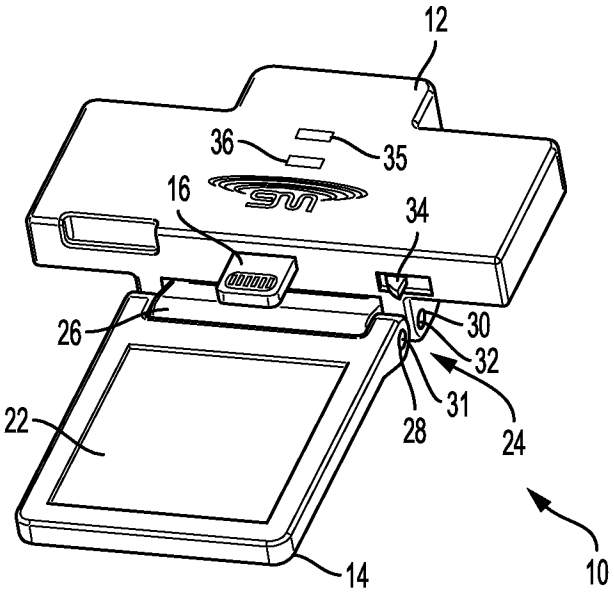
FIG. 2 is a second perspective view of an embodiment of an anti-theft tag used for portable electronic devices.
Figure 1:
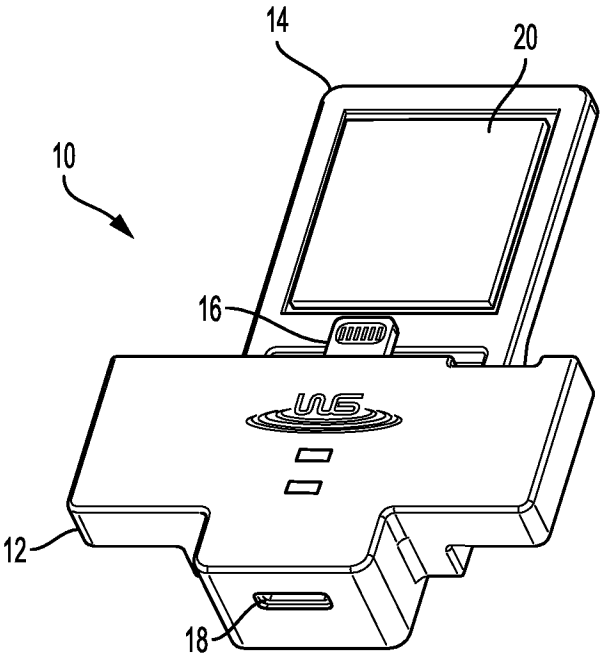
FIG. 1 is a first perspective view of an embodiment of an anti-theft tag used for portable electronic devices.
Figure 6:
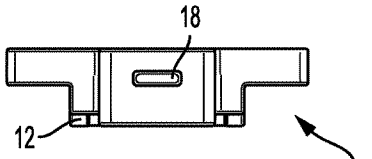
FIG. 6 is a first end view of an embodiment of an anti-theft tag used for portable electronic devices.
Figure 7:
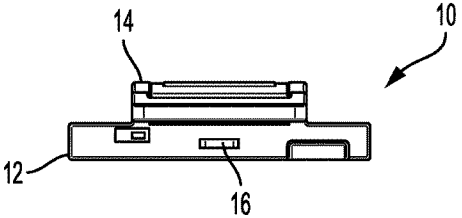
FIG. 7 is a second end view of an embodiment of an anti-theft tag used for portable electronic devices.

FIG. 1 is a first perspective view of an embodiment of electronic article surveillance (EAS) device 10 for portable electronic devices. FIG. 2 is a second perspective view of an embodiment of the EAS device 10 for portable electronic devices. Device 10 has body 12 and panel 14 extending from body 12. Also extending from body 12 is male plug 16. Male plug 16 is compatible with a respective female plug in a portable electronic device for which EAS device 10 is intended. This allows device 10 to be attached to the respective portable electronic device by inserting male plug 16 into a feature inherent to the portable electronic device.

Referring now to FIG. 1 only, female receptacle 18 is recessed into body 12 of device 10. In embodiments of device 10 having female receptacle 18, female receptacle 18 has electrical continuity with male plug 16. This allows the electronic device to be charged while device 10 is plugged into the electronic device. This allows the electronic device to be maintained in a charged condition while it is available for review by consumers and protected by device 10. In the embodiment shown in FIG. 1, female receptacle 18 is like the female receptacle of the respective electronic device, i.e. male plug 16 would fit in female receptacle 18. This provides the convenience that the charger that is intended for a given electronic device can be used to maintain the device in charged state while on display. However, the physical compatibility between male plug 16 and female receptacle 18 is not a requirement. It is only needed that a suitable electrical compatibility can be established between the charger and the electronic device. Similarly, male plug 16 and female receptacle 18 are located opposite of each other in FIG. 1, this is not a required arrangement.

In addition to plug 16, device 10 may have an additional attaching mechanism for attaching device 10 to a portable electronic device. In the embodiment of FIG. 1, panel 14 helps maintain device 10 attached to the portable electronic device. In FIG. 1, adhesive element 20 is in place on panel 14. In FIG. 2, adhesive element 20 is absent and recess 22 is more fully visible. Once device 10 is attached to an electronic device by inserting male plug 16 into a receptacle in the electronic device, adhesive element 20 on panel 18 is brought into contact with the electronic device to maintain device 10 in place.

In some embodiments, panel 18 is connected to body 12 by a hinge to facilitate moving panel 18 and adhesive element 20 into contact with the electronic device. In the embodiment shown in FIG. 2, panel 18 is connected to body 12 by double hinge 24. Double hinge 24 gives an additional degree of freedom in applying adhesive element 20 to the electronic device. Coupler 26 between panel 18 and body 12 is hinged to both panel 18 and body 12 to form double hinge 24. Panel 18 has pin apertures 28 in panel 18 and body 12 has pin apertures 30 in body 12. Coupler 26 has pin apertures matching the pin apertures in panel 18 and body 12. Hinge pins 31 and 32 insert through pin apertures 28 and 30 and the matching apertures in coupler 26 to form double hinge 24.

Although adhesive element 20 maintains device 10 on the electronic device under normal conditions, it may not be sufficient to prevent the forced removal of device 10 by a determined thief. For that reason, some embodiments of device 10 employ additional electronic monitoring elements capable of detecting when device 10 has been removed without authorization and generating an alarm when the electronics determine an alarm condition. In FIG. 2, switch 34 protrudes from body 12 of device 10. Switch 34 has at least two states; open, closed. When device 10 is attached to an electronic device, switch 34 is depressed and its state is changed from the state it has when device 10 is unattached. This change of state in switch 34 is registered by the electronics within device 10 as indicating that device 10 is attached to an electronic device, and device 10 and the electronics within device 10 may be said to be armed by switch 34. In some embodiments, the electronics within device 10 will also monitor male plug 16 as a further indication that device 10 has been attached to an electronic device. This may be done by registering a change in impedance. Depending on the embodiment of device 10 and the machine executable instructions in its microprocessor, device 10 may be armed by changes at switch 34, male plug 16, or both switch 34 and male plug 16.

Referring to both FIGS. 1 and 2, optical windows 35 and 36 allow optical communication by the electronics within body 12 of device 10. Optical windows 35 and 36 may be open apertures or may have translucent coverings. The communication may take the form of the flashing from a light emitting diode (LED) in body 12 or the reception of infrared (IR), or other optical signals, at a receiving optical port in body 12. For example, a flashing LED could indicate when device 10 has been armed, or an authorized person can use an external device to send IR signals to disarm the alarming functions of device 10 before it is removed.

Figure 5:
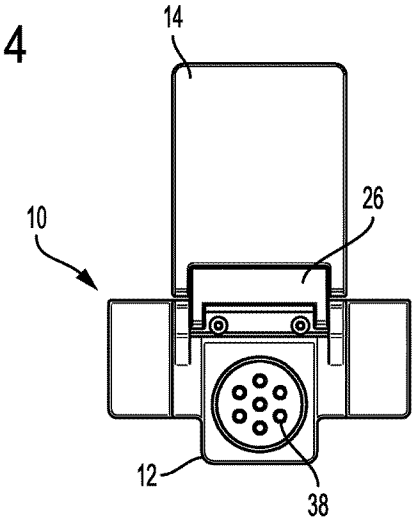
FIG. 5 is a second plan view of an embodiment of an anti-theft tag used for portable electronic devices.
Figure 4:
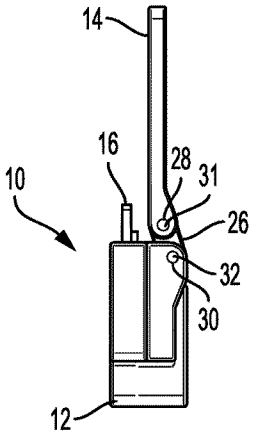
FIG. 4 is a side view of an embodiment of an anti-theft tag used for portable electronic devices.
Figure 3:
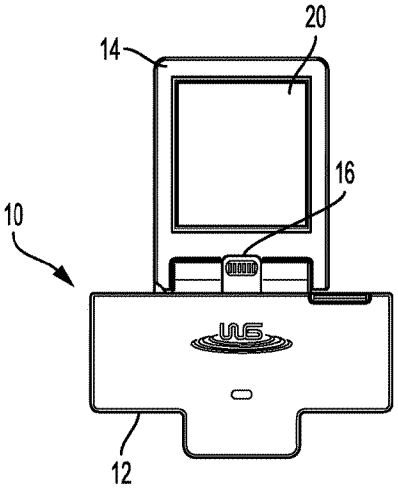
FIG. 3 is a first plan view of an embodiment of an anti-theft tag used for portable electronic devices.

FIGS. 3, 4, 6 and 7 show additional views of embodiments having features already discussed with respect to the embodiments shown in FIGS. 1 and 2. FIG. 5, however, shows an embodiment of device 10 and another possible set of features for device 10. Sound apertures 38 in body 12 facilitate the sounding of audible alarms by an audible sound generator in the electronics within body 12 of device 10.

Figure 8:
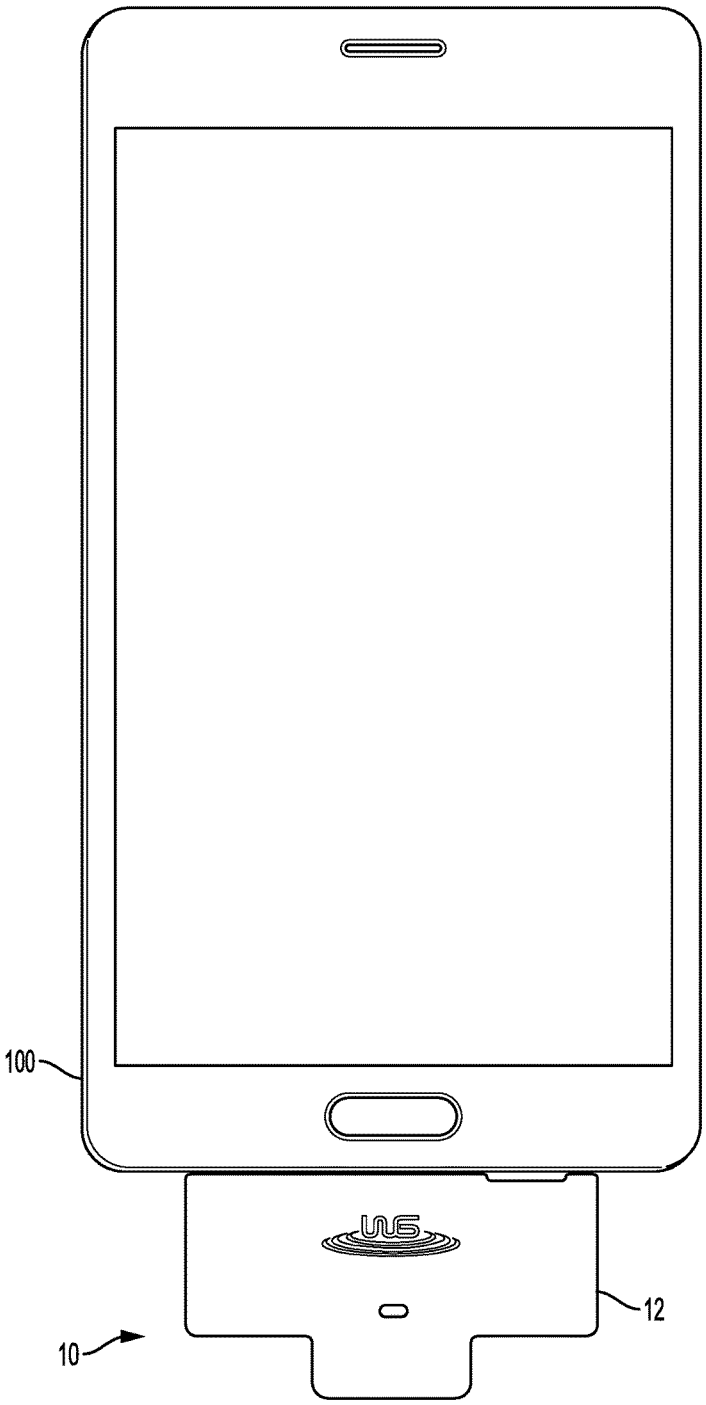
FIG. 8 is a first view of an embodiment of an anti-theft tag configured for cell phones and attached to a cell phone.
Figure 9:
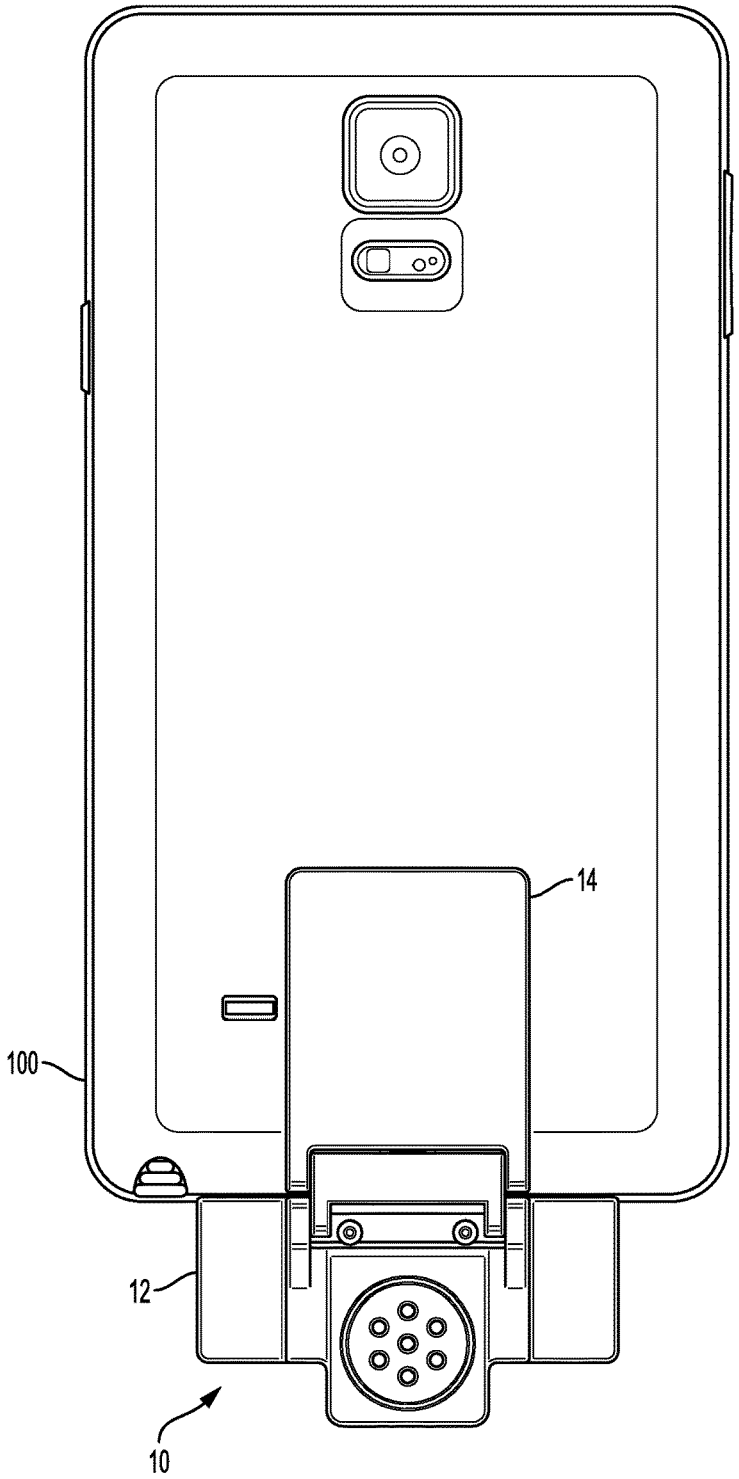
FIG. 9 is a second view of an embodiment of an anti-theft tag configured for cell phones and attached to a cell phone.

FIGS. 8 and 9 show an embodiment of the EAS device 10 configured for cell phones attached to a cell phone 100. Device 10 is attached to the end of cell phone 100 where the charging port of cell phone 100 is located. Panel 14 is in contact with cell phone 100 and assists in maintaining device 10 attached to cell phone 100. Although the embodiment of device 10 in FIGS. 8 and 9 are sized and configured for a cell phone. Other embodiments may be sized and configured to fit other portable electronic devices having externally accessible ports or jacks.

Figure 10:
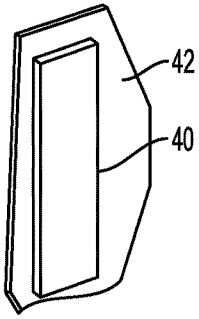
FIG. 10 is a perspective view of a passive anti-theft acousto-magnetic label attached to the interior of a section of housing.

FIG. 10 is a perspective view of a passive electronic article surveillance acousto-magnetic (AM) label 40 attached to the interior of a section of housing 42. AM labels such as label 40 are a common passive EAS element that function at approximately 58 kHz frequency within the radio frequency range. Frequently, anti-theft systems place field transmitting units at controlled locations to intermittently generate interrogation fields at a specific frequency. AM labels are tuned to generate response signals when energized by the specific frequency. The field transmitting units monitor for the label response signals between bursts of the interrogation field. When a label response is detected, the system evaluates the situation and may generate an alarm. Some embodiments of EAS device 10 have an AM label 40 on the interior of body 12 to provide a way to detect the presence of device 10 in controlled locations. A common operating frequency for systems using a label such as AM label 40 is 58 kHz. Radio communication circuitry 57 may operate at this frequency as well. However, radio communication circuitry 57 is not limited to this specific frequency or any other frequency.

Figure 11:
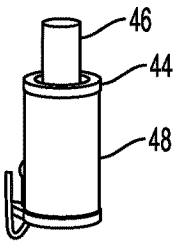
FIG. 11 is a perspective view of a passive anti-theft core and coil element.

FIG. 11 is a perspective view of a passive anti-theft core and coil element 44. Core and coil element 44 is comprised of a central ferrite core 46 with a conductive coil 48 wrapped around it. When subjected to a radio frequency field, core and coil element 44 is energized. When the field is removed, the energy dissipates, and core and coil element 44 generates a signal as it "rings" down. This signal can be detected by the EAS system. Core and coil element 44 can be tuned to the frequency of the field. Some embodiments of EAS device 10 have a core and coil element 44 in the interior of body 12 to provide a way to detect the presence of device 10 in controlled locations.

Figure 12:
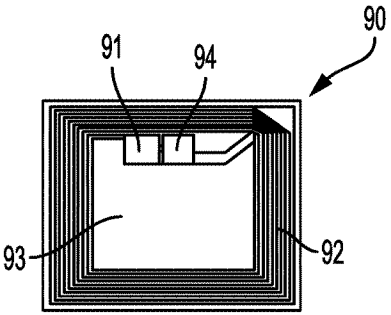
FIG. 12 is a schematic image of a passive RFID label.

FIG. 12 is a schematic image of RFID label 90 which is known in the art. Typically, RFID label 90 has IC chip 91 and antenna 92 mounted on substrate 93. Some RFID labels 90 may also have a capacitor 94 to improve some aspects of the performance of RFID label 90. IC chip 91 has memory which is accessible by external devices with radio frequency communication via antenna 92. Some IC chips 91 have rewritable memory and can have information about the objects to which they are attached written to their memory. RFID label 90 may be placed within body 12 of device 10 to interact with a system that is already in place in a retail location. A common operating frequency for systems using a label such as RFID label 90 is 13.56 MHz. Radio communication circuitry 57 may operate at this frequency as well. However, radio communication circuitry 57 is not limited to this specific frequency or any other frequency.

Figure 13:
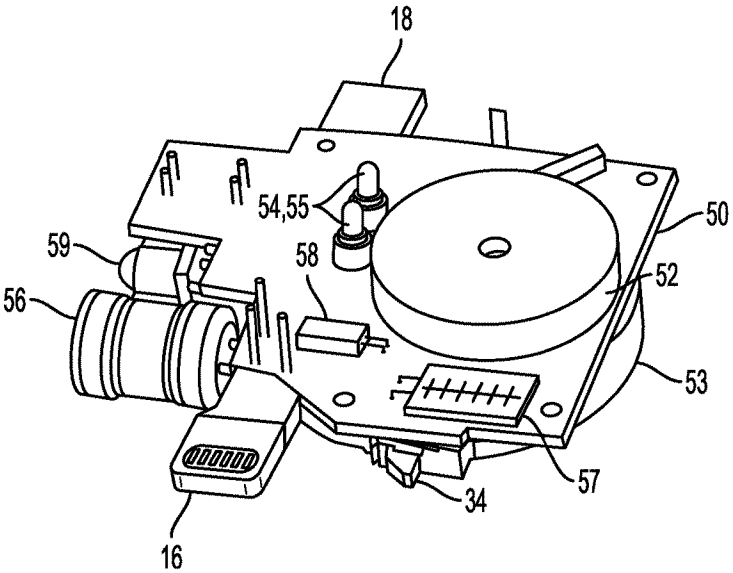
FIG. 13 is a perspective view of an embodiment of a set of electronic article surveillance electronics contained in embodiments of an anti-theft tag.

FIG. 13 is a perspective view of an embodiment of a set of electronic article surveillance electronics contained in embodiments of the anti-theft tag. Among the electronic elements that may be contained in body 12 are: circuit board 50; arming switch 34; microprocessor 52; audible sound generator 53; infrared communication port 54; light emitting diode 55; battery 56; radio communication circuitry 57; motion detection chip 58; and magnetometer 59. In addition to the elements just listed, the EAS electronics in device 10 may include a passive EAS element, such as a passive core and coil element 44 or a passive acousto-magnetic label 40. Also, male plug 16 and female receptacle 18 may be monitored by microprocessor 52 and therefore may also be considered as elements of the EAS electronics set. In FIG. 13, male plug 16 and female receptacle 18 are offset from each other, rather than aligned with each other as in the embodiment of FIG. 1

Circuit board 50 and microprocessor 52 monitor several inputs and execute machine readable instructions and generate outputs based on the instructions and inputs. When male plug 16 is inserted into the female receptacle of an electronic device, switch 34 is depressed and its state is changed, arming the electronics in device 10. Male plug 16 may also be monitored for confirmation that device 10 is attached to an electronic device. The arming of EAS device 10 may be automatic or it may be completed by communication from an external device. Other embodiments of EAS device 10 may be armed by communication from an external device.

The final arming of EAS device 10 may be automatic or it may be completed by communication from an external device. Infrared communications port 54 and radio communication circuitry 57 provide means for device 10 to receive a signal from an external device such as a handheld device held by an authorized person. LED 55 and audible alarm generator 53 allow device 10 to communicator directly to persons. When device 10 is plugged into an electronic device, device 10 may provide a confirmation signal by flashing LED 55 or issuing sounds from audible sound generator 53. An operator may then use an external device to send an optical signal to infrared communication port 54 or a radio signal to radio communication circuitry 57 to finalize arming device 10.

An external device may also be used to disarm device 10 before it is removed. Some embodiments of device 10 will store a passcode in microprocessor 52. The external device must communicate the appropriate passcode before device 10 will communicate with the external device or allow its status or machine readable instructions to be modified by the external device. The wrong passcode may itself be a cause to issue alarm.

Once device 10 is installed, the electronics monitor at least switch 34. If device 10 is removed without its electronics being disarmed, the electronics may determine an alarm condition and generate an alarm. This alarm may be an audible alarm generated by audible sound generator 53, a radio signal generated by radio communication circuitry 57, or an optical signal from LED 55. The radio signal alarm and optical signal alarm may be detected by elements in the electronic article surveillance system monitoring the area in which device 10 and its respective electronic device are located. The EAS system may then respond as programmed, for example by sounding alarms, displaying alarms on computer screens, etc.

Radio communication circuitry 57 in device 10 can also communicate with the EAS system to monitor the location of device 10. Radio communication circuitry 57 can communicate actively with the EAS system or monitor for interrogation fields such as those used to stimulate passive EAS elements. If radio communication circuitry 57 detects an interrogation field, the electronics in device 10 may determine an alarm condition and activate. Alternatively, the EAS system may instruct device 10 to generate an alarm as well.

In some embodiments, the electronics of device 10 are powered by battery 56. Some embodiments of device 10 may also have a motion sensor 58. Motion sensor 58 may be employed to conserve battery life. Motion sensor 58 monitors for motion and is in communication with microprocessor 52. After a preprogrammed period of stasis, with the exception of microprocessor 52 and motion sensor 58, the electronics of device 10 go dormant. Motion sensor 58 monitors for movement of device 10 and microprocessor 52 is in communication with motion sensor 58 to receive notice that device 10 is being moved. When motion sensor 58 detects that device 10 is in motion, the other electronic elements of device 10 in addition to motion sensor 58 and microprocessor 52 become active. In some embodiments of device 10, battery 56 may also be rechargeable when the charger for the electronic device is connected to female receptacle 18.

Magnetometer 59 provides another method for the electronics of device 10 to monitor the status of device 10 and its environment. Magnetometer 59 measures magnetic fields around device 10 and communicates a digitized representation of the fields to microprocessor 52. Microprocessor 52 stores the digitized representations of the magnetic environment and compares them to each other over time for changes, consistency, etc. Sudden changes may indicate an alarm condition is present. For example, if the surrounding field is suddenly attenuated, it may be an indication that a thief has isolated device 10 and its electronic device by placing them in a foil bag. In such a case, microprocessor 52 may issue an audible alarm from audible sound generator 53.

Figure 14:
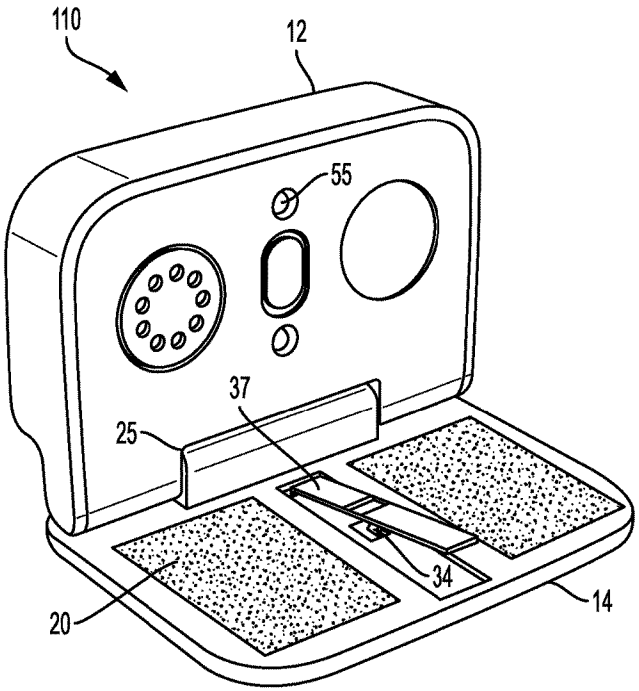
FIG. 14 is a perspective view of an embodiment of an electronic article surveillance anti-theft device.

In reference to FIGS. 14-21, like numbers will be used for similar elements. FIG. 14 is a perspective view of an embodiment of an electronic article surveillance (EAS) anti-theft device 110. EAS device 110 has a housing 12 and a panel 14 extending from housing 12. Panel 14 has adhesive element(s) 20 on its surface for attaching EAS device 110 to an article to be protected. Panel 14 also has switch 34 for detecting when device 110 is attached to an article. Switch 34 is in electrical continuity with electronic article surveillance (EAS) electronics within housing 12. The EAS electronics within housing 12 monitor switch 34 to detect whether EAS device 110 is attached to an object.

Figure 15:
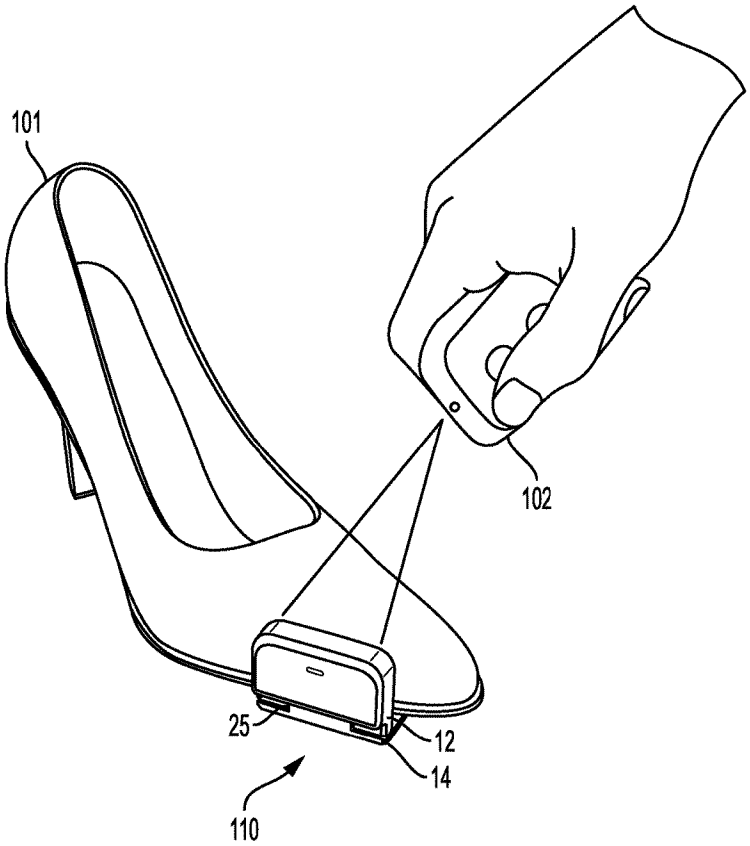
FIG. 15 is a perspective view of an embodiment of the electronic article surveillance anti-theft device of FIG. 14 attached to a shoe.

FIG. 15 is a perspective view of an embodiment of the EAS device 110 of FIG. 14 attached to a shoe 101. Panel 14 is attached to the sole of shoe 101 which changes the state of switch 34. FIG. 15 also shows external handheld device 102 being used to arm EAS device 110 once it is attached to an object such as shoe 101. When switch 34 changes state, the electronics of EAS device 110 may send a signal that EAS device 110 is attached and ready to be armed. External device 102 may send a signal to the electronics of EAS device 110 to finalize arming or activating EAS device 110.

Figure 16:
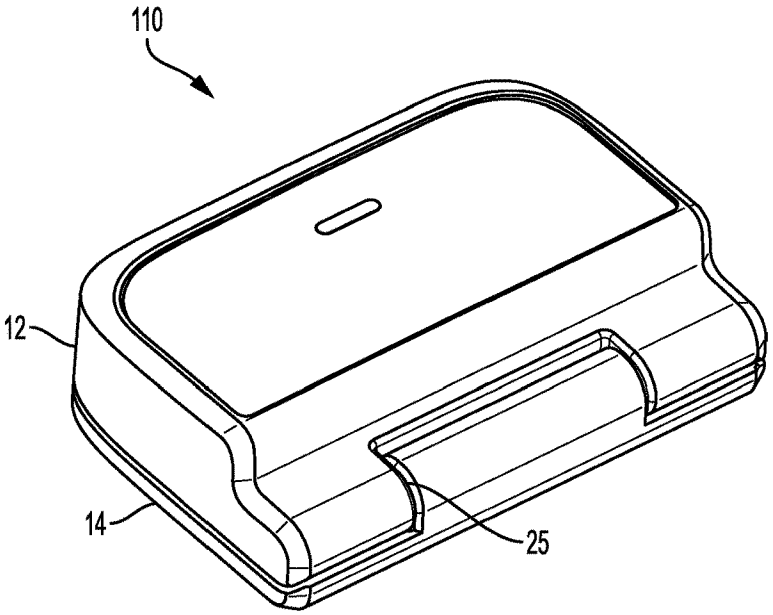
FIG. 16 is a rear perspective view of an embodiment of an electronic article surveillance anti-theft device folded closed.

In the embodiment of EAS device 110 of FIG. 14, panel 14 is attached to housing 12 by hinge 25. FIG. 16 is a rear perspective view of an embodiment of an EAS anti-theft device 110 folded closed. Panel 14 is rotated about hinge 25 until it is against housing 12 of EAS device 110.

Figure 17:
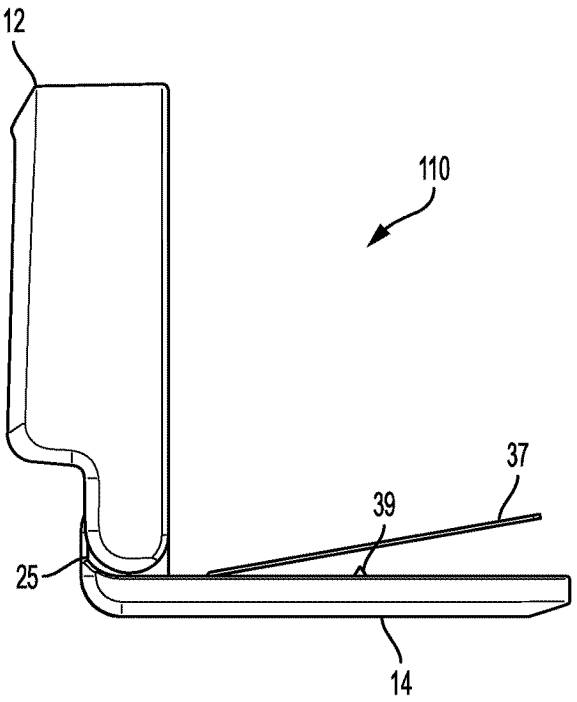
FIG. 17 is a side view of an embodiment of an electronic article surveillance anti-theft device folded open and showing a contact beneath a hinged lever.
Figure 18:
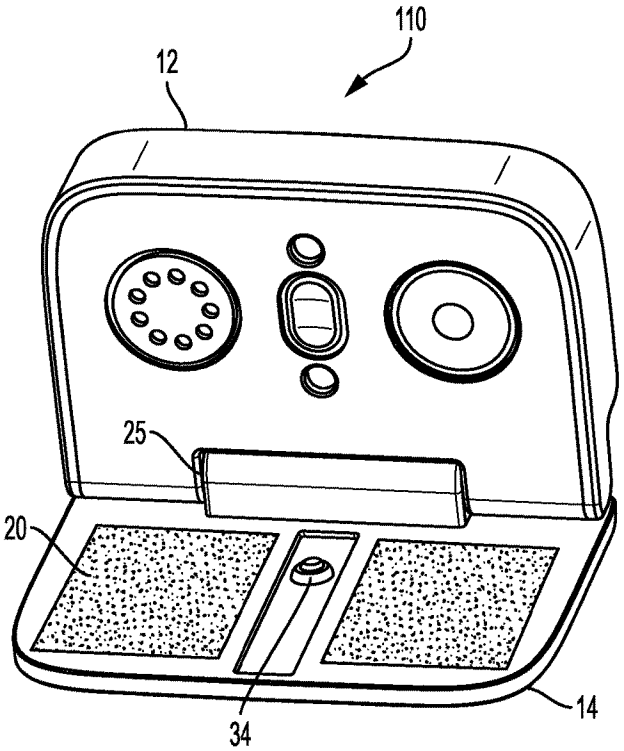
FIG. 18 is a front perspective view of an embodiment of an electronic article surveillance anti-theft device having a switch protruding from a panel extending from its housing.

In the embodiment EAS device 110 of FIG. 14, hinged lever 37 is hinged into the surface 15 of panel 14 that contacts an object. Hinged lever 37 may be positioned over a switch or may be part of a switch circuit. In FIG. 14, a switch 34 is mounted in panel 14 beneath hinged lever 37. When panel 14 is attached to an object, hinged lever 37 presses down onto switch 34, changing its state. FIG. 17 is a side view of an embodiment of EAS anti-theft device 110 folded open and showing contact 39 beneath a hinged lever 37. Both hinged lever 37 and contact 39 are in electrical continuity with the electronics within housing 12. When panel 14 is attached to an object, hinged lever 37 acts as a second contact pressing down onto (first) contact 39, completing a circuit like closing a switch. FIG. 18 is a front perspective view of an embodiment of an EAS anti-theft device 110 having a switch 34 protruding from a panel extending from its housing. In the embodiment of FIG. 18, switch 34 operates without any assistance from a hinged lever, such as hinged lever 37 shown in FIGS. 14 and 17.

Figure 19:
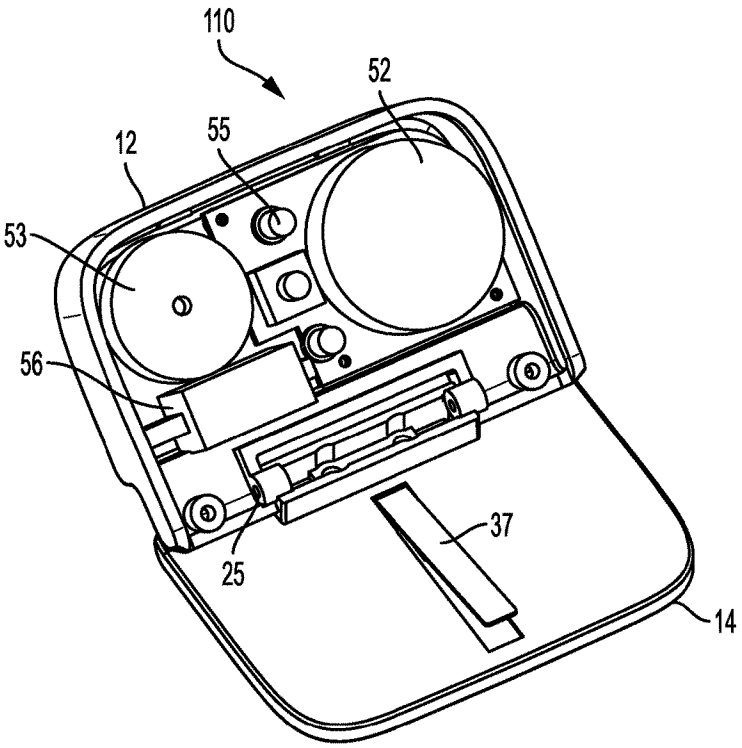
FIG. 19 is a front perspective view of an embodiment of an electronic article surveillance anti-theft device showing internal electronics.

FIG. 19 is a front perspective view of an embodiment of EAS anti-theft device 110 showing internal electronics. EAS device 110 of FIG. 19 has many of the electronic components of the embodiments of EAS device 110 as shown in FIG. 13. Other elements are present but not visible in FIG. 19. Microprocessor 52 executes machine readable instructions based upon signals it receives. Audible signal generator 53 generates sounds to communicate the status of EAS device 110 and to generate audible alarms. Light emitting diode 55 also communicates the status of EAS device 110 as well as other information. Light emitting diode 55 may also be used in wireless optical communication. Power source, or battery, 56 powers the electronics. As with previously discussed embodiments, EAS device 110 can communicate wirelessly via radio frequency (RF) circuitry, or optically, with infrared (IR) communication.

Figure 20:
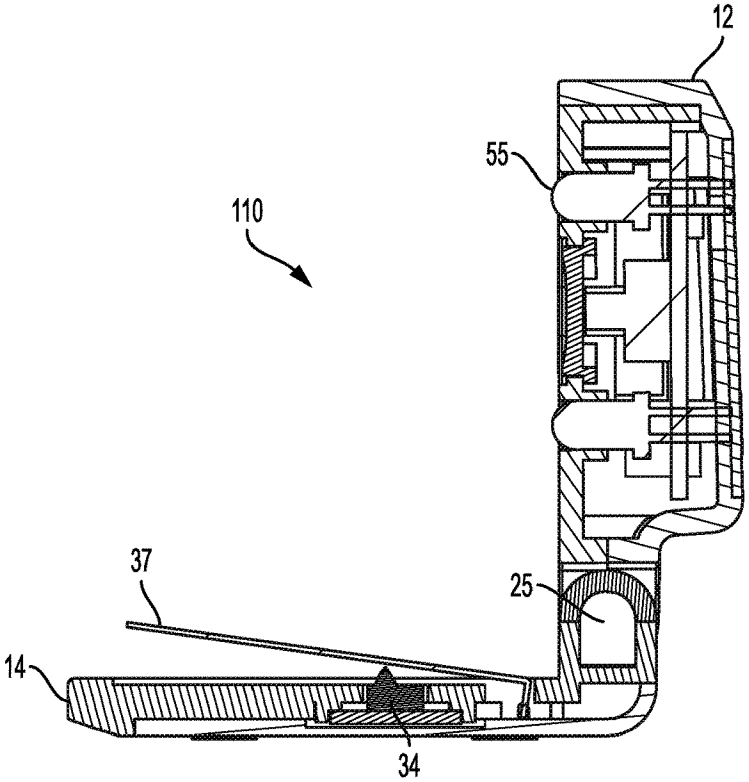
FIG. 20 is a cross sectioned view of an embodiment of an electronic article surveillance anti-theft device showing a switch located inside a panel extending from a housing.

FIG. 20 is a cross sectioned view of an embodiment of an electronic article surveillance anti-theft device 110 showing switch 34 located inside panel 14 extending from housing 12. Switch 34 is in electrical continuity with the electronics contained in housing 12. The electronics in housing 12 can detect when the state, open, closed, etc., of switch 34 changes. This serves as an indicator to the electronics of EAS device 110 whether EAS device 110 is attached to an object to be protected, or whether panel 14 is closed against housing 12. When panel 14 is closed against housing 12 (refer to FIG. 16), switch 34 changes state and the EAS device is locked into an off state to save battery 56. Alternatively, when EAS device 110 is attached to an item to be protected, switch 34 indicates that EAS device 110 is ready to be fully armed, or activated. As shown in FIG. 15, external device 102 may be used to communicate with EAS device 110 via radio frequency wireless or infrared wireless, to fully arm EAS device 110. Later, a change in state of switch 34 may indicate that EAS device 110 has been removed. If EAS device 110 has not been previously disarmed, its removal may indicate that an alarm condition exists. The electronics within housing 12 may then generate an alarm.

EAS device 110 may generate several types of alarms. Audible signal generator 53 may generate the most immediate alarm by generating audible alarms. LED 55 may flash visible alarm signals. Additionally, wireless communication elements such as radio communication circuitry 57 and infrared communication port 54 (see FIG. 13) may communicate alarms to the larger EAS system. In addition to alarms, the wireless communication elements may communicate other information about the status of EAS device 110 to the larger EAS system such as valid opening, invalid opening, enabled, disabled, armed, disarmed, etc. The larger EAS system may also include a cloud element wherein the EAS system information is remotely accessible, and the EAS system may be managed from afar.

In the embodiment of FIG. 20, hinged lever 37 is hinged to panel 14 and lays over switch 34. Hinged lever 37 has a larger contact area than the actuator of switch 34 and compensates for irregularities on the object to which EAS device 110 is attached. Hinged lever 37 may also serve to protect switch 34.

Figure 21:
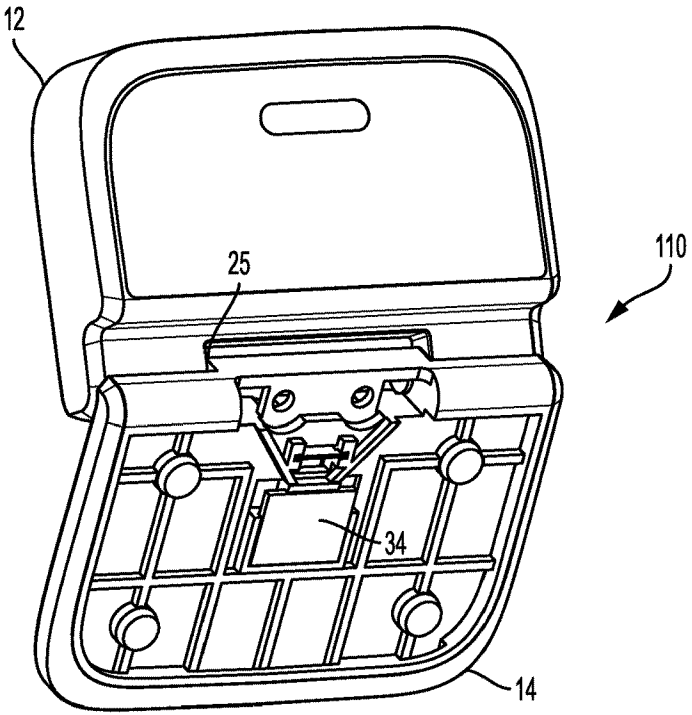
FIG. 21 is a bottom perspective view of an embodiment of an electronic article surveillance anti-theft device showing inside a panel extending from the housing.

FIG. 21 is a bottom perspective view of an embodiment of an electronic article surveillance anti-theft device showing inside of panel 14 extending from housing 12. The bottom surface of panel 14 is removed. The bottom of switch 34 or contact 39 may be seen. Microprocessor 52 monitors switch 34 or contact 39 as a signal that EAS device 110 is attached to an object to be protected.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. For example panel 14 and its complementary surface on housing 12 are generally flat. However, in some embodiments, panel 14 and the complementary surface may be curved, or shaped, to match an object to which it will be attached. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. An electronic article surveillance (EAS) device comprising:

a housing;

electronic article surveillance (EAS) electronics within said housing;

a panel extending from said housing said panel having a contact surface and an adhesive element on said contact surface of said panel; and, a switch associated with said contact surface of said panel, said switch having at least two states, open and closed, said switch changing state when said panel is attached to an object by said adhesive element, said EAS electronics monitoring said switch for a change of state.

2. The EAS device of claim 1, wherein:

said switch comprises a plunger switch protruding from said contact surface of said panel.

3. The EAS device of claim 1, wherein:

said switch comprises a first electrical contact on said contact surface of said panel; and, a second electrical contact mounted on said panel and proximal to said first electrical contact;

said second contact being moved into contact with said first electrical contact when said panel is attached to the object.

4. The EAS device of claim 1, wherein:

said panel is attached to said housing by a hinge.

5. The EAS device of claim 4, wherein:

said panel may be folded against said housing when said panel is not attached to the object.

6. The EAS device of claim 1, wherein:

When said panel is folded against said housing, said switch changes state and disconnects at least a portion of said EAS electronics within said housing.

7. The EAS device of claim 1, wherein:

said contact surface of said panel is generally flat.

8. The EAS device of claim 1, wherein:

said EAS electronics comprise a microprocessor, wireless communication elements, and a power supply.

9. The EAS device of claim 8, wherein:

said wireless communication elements comprise radio frequency communication circuitry.

10. The EAS device of claim 8, wherein:

said wireless communication elements comprise optical communication elements.

11. The EAS device of claim 8, wherein:

said wireless communication elements may receive signals from an external device to arm or disarm the EAS device.

12. The EAS device of claim 8, wherein:

said wireless communication elements may communicate the status of the EAS device to an external EAS system.

13. The EAS device of claim 12, wherein:

the external EAS system comprises cloud functionality.

14. The EAS device of claim 8, wherein:

said EAS electronics further comprise an audible sound generator.

15. The EAS device of claim 1, wherein:

said EAS electronics comprise a passive EAS element.

* * * * *